US006871628B1

(12) United States Patent
Tauer

(10) Patent No.: US 6,871,628 B1
(45) Date of Patent: Mar. 29, 2005

(54) MOTORCYCLE FLUID COOLER AND METHOD

(75) Inventor: Jason Tauer, 527 Hickory St., Mankato, MN (US) 56001

(73) Assignee: Jason Tauer, Mankato, MN (US)

( * ) Notice: Subject to any disclaimer, the term of this patent is extended or adjusted under 35 U.S.C. 154(b) by 5 days.

(21) Appl. No.: 10/732,027

(22) Filed: Dec. 9, 2003

(51) Int. Cl.[7] ..... F01P 11/08

(52) U.S. Cl. ..... 123/196 AB; 123/41.33; 123/195 C; 184/104.3; 180/229; 165/44

(58) Field of Search ..... 123/196 AB, 41.33, 123/41.42, 41.48, 41.52, 195 C, 198 E; 184/104.3; 180/229; 165/44

(56) References Cited

U.S. PATENT DOCUMENTS

| | | | | |
|---|---|---|---|---|
| 4,339,964 A | | 7/1982 | Isaka | |
| 4,662,470 A | | 5/1987 | Fujisawa et al. | |
| 4,928,651 A | * | 5/1990 | Kronich | 123/196 AB |
| 4,995,448 A | * | 2/1991 | Inagaki et al. | 165/44 |
| 5,199,395 A | * | 4/1993 | Mizumura et al. | 123/196 AB |
| 5,244,036 A | | 9/1993 | Michl | |
| 5,307,865 A | | 5/1994 | Inagaki et al. | |
| 5,363,823 A | | 11/1994 | Gittlein | |
| 5,477,817 A | * | 12/1995 | Hufendiek et al. | 123/41.33 |
| D372,213 S | | 7/1996 | Blennov | |
| 5,653,206 A | | 8/1997 | Spurgin | |
| 5,685,368 A | | 11/1997 | Yuasa et al. | |
| 5,701,853 A | | 12/1997 | Takahashi | |
| 5,715,778 A | | 2/1998 | Hasumi et al. | |
| 5,887,561 A | | 3/1999 | Spurgin | |
| 5,901,808 A | | 5/1999 | Swenson et al. | |
| 6,058,898 A | * | 5/2000 | Freese, V | 123/195 C |

* cited by examiner

*Primary Examiner*—Weilun Lo
(74) *Attorney, Agent, or Firm*—Merchant & Gould PC

(57) ABSTRACT

A fluid cooling arrangement for a motorcycle including a fluid cooler with an outer housing and an inner plate. The outer housing includes an outer face and an inner face. The inner plate is mounted to the inner face of the outer housing. A continuous fluid passage is defined between the inner face and the inner plate, and the fluid passage extends between a fluid inlet and a fluid outlet. The fluid cooler mounted to a primary drive of a motorcycle. The primary drive connects an output shaft of the engine with an input shaft of a transmission. The fluid inlet is in fluid communication with a source of heated fluid from the engine.

16 Claims, 19 Drawing Sheets

FIG. 21
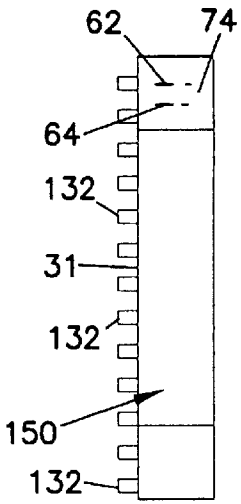
FIG. 20
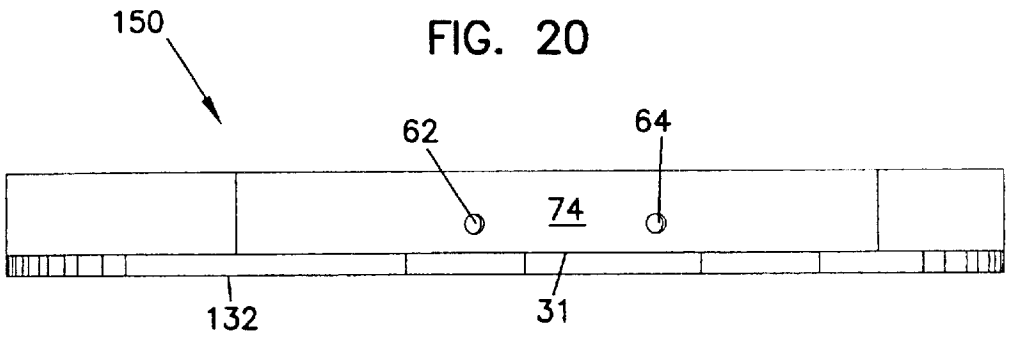
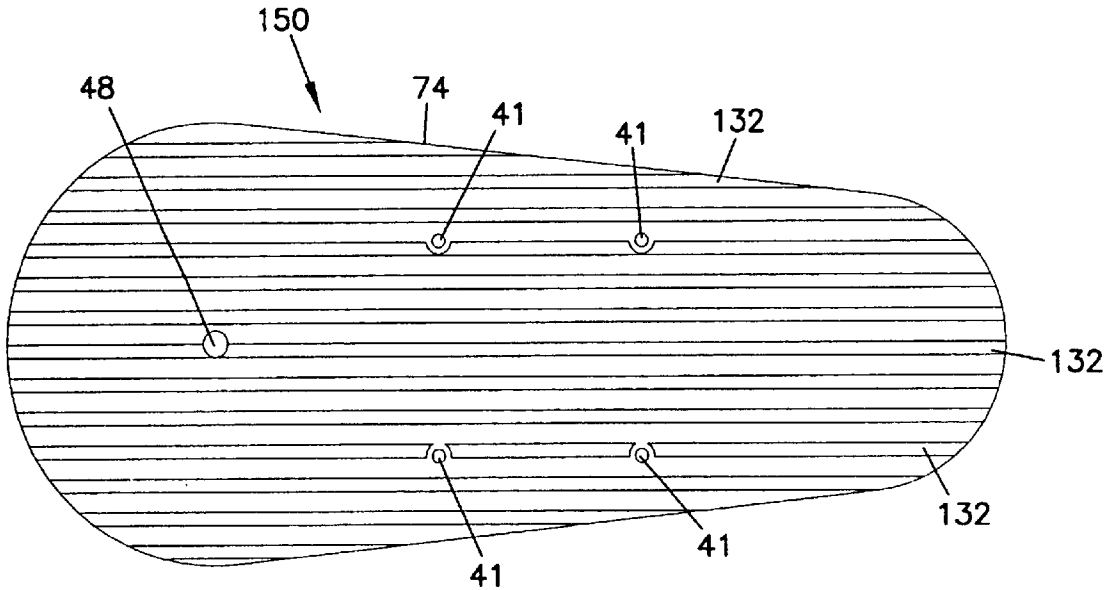
FIG. 19

MOTORCYCLE FLUID COOLER AND METHOD

TECHNICAL FIELD

The present invention relates generally to fluid coolers for use on motorcycles.

BACKGROUND

Motorcycles may use either air- or water-cooling to keep engine temperatures at acceptable levels. Air-cooled engines rely on air flowing across the outer surfaces of the engine to provide cooling of the beat generated by combustion. While convection and ambient wind may provide some airflow to aid cooling the engine, air-cooled engines rely on air movement generated by forward motion of the motorcycle to provide the bulk of the cooling effect. In situations where the motorcycle's engine is being run for extended periods of time without forward movement of the motorcycle (for example, when the motorcycle is stuck in traffic), the engine may overheat, damaging the engine. Improvements to the ability to cool air-cooled engines are desirable.

One approach to improved cooling of air-cooled motorcycle engines is to utilize the oil used to lubricate the operation of the engine to also carry some of the heat away from the engine. The oil circulated through the engine comes into contact with engine parts heated by combustion or exhaust gases. As the oil circulates through the engine, the oil filter and the oil pan, some of the heat is dissipated but it is desirable to improve the ability of the oil to dissipate heat before being recirculated through the engine. It is known to direct the heated oil through heat sinks, radiators or other similar structures to improve the ability of the oil to aid in engine cooling.

At the same time, for aesthetic reasons, many motorcyclists prefer not to have an obvious structure, such as a finned radiator or other traditional heat sink, attached to their motorcycle, even though such a structure might perform the desired function. Some of these non-obvious approaches have included circulation of the oil through frame members of the motorcycle or through foot and motor guards. Improvements to the non-obvious structures for aiding the ability of engine oil to cool motorcycle engines are desirable.

SUMMARY OF THE INVENTION

The present invention relates generally to providing cooling for heated fluids circulated through a motorcycle engine.

More specifically, the present invention relates to a fluid cooling arrangement for a motorcycle including a fluid cooler with an outer housing and an inner plate. The outer housing includes an outer face and an inner face. The inner plate is mounted to the inner face of the outer housing. A continuous fluid passage is defined between the inner face and the inner plate, and the fluid passage extends between a fluid inlet and a fluid outlet. The fluid cooler mounted to a primary drive of a motorcycle. The primary drive connects an output shaft of the engine with an input shaft of a transmission. The fluid inlet is in fluid communication with a source of heated fluid from the engine.

The present invention further relates to an oil cooler for a motorcycle including an assembly of an outer housing having an inner face and an outer face and an inner plate is mounted to the inner face of the outer housing. A plurality of fluid passages between the inner plate and the inner face define a continuous oil path from an oil inlet to an oil outlet. The outer housing and inner plate assembly is adapted for mounting to an outer portion of a primary drive of a motorcycle.

The present invention further relates to a method of mounting an oil cooler to a motorcycle including providing a motorcycle with an engine including an output shaft, a transmission with an input shaft, and a primary drive connecting the output shaft to the input shaft. The primary drive includes a member for transmitting movement of the output shaft to the input shaft. An inner plate is mounted to an inner face of an outer housing to form an oil cooler assembly. The oil cooler assembly includes a plurality of oil passages between the inner plate and the inner face for routing oil from an oil inlet to an oil outlet. The oil cooler assembly is attached to an outer portion of the primary drive with the oil cooler assembly positioned as a member guard. The fluid inlet of the cooler assembly is connected with a source of heated oil from the engine.

BRIEF DESCRIPTION OF THE DRAWING

The accompanying drawings, which are incorporated in and constitute a part of the description, illustrate several aspects of the invention and together with the detailed description, serve to explain the principles of the invention. A brief description of the drawings is as follows:

FIG. 19 is a side view of the outer housing of FIG. 17.

FIG. 20 is a bottom view of the outer housing of FIG. 17.

FIG. 21 is an end view of the outer housing of FIG. 17.

DETAILED DESCRIPTION

Reference will now be made in detail to exemplary aspects of the present invention which are illustrated in the accompanying drawings. Wherever possible, the same reference numbers will be used throughout the drawings to refer to the same or similar parts.

Figure 1:
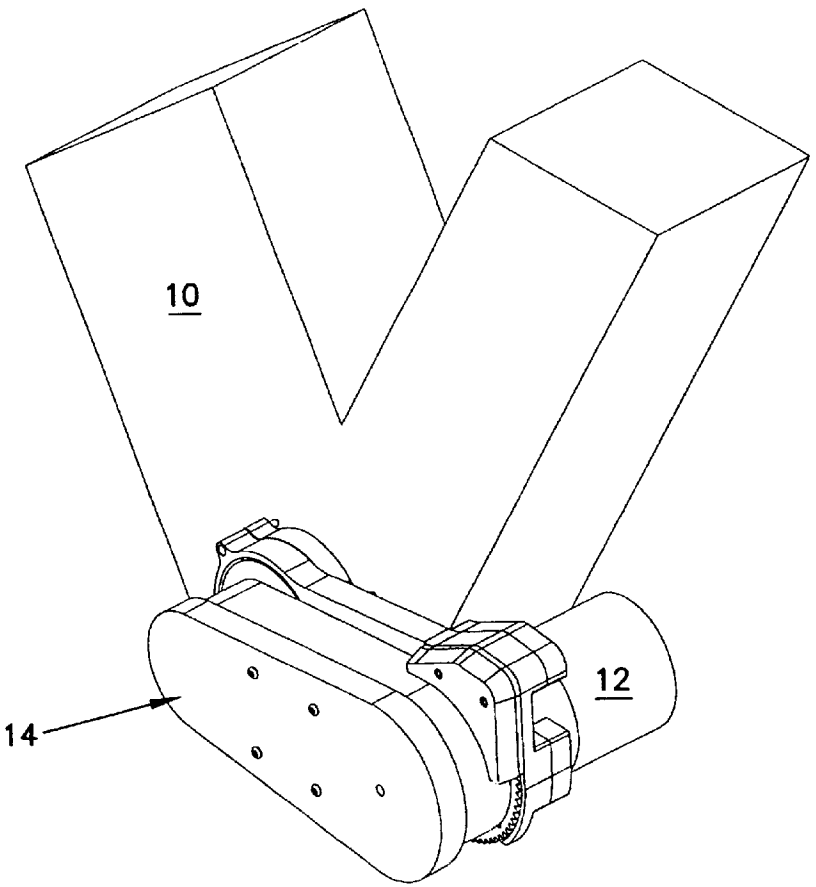
FIG. 1 is a perspective schematic view of a motorcycle engine and transmission with a primary drive assembly including an oil cooler in accordance with the present invention.
Figure 2:
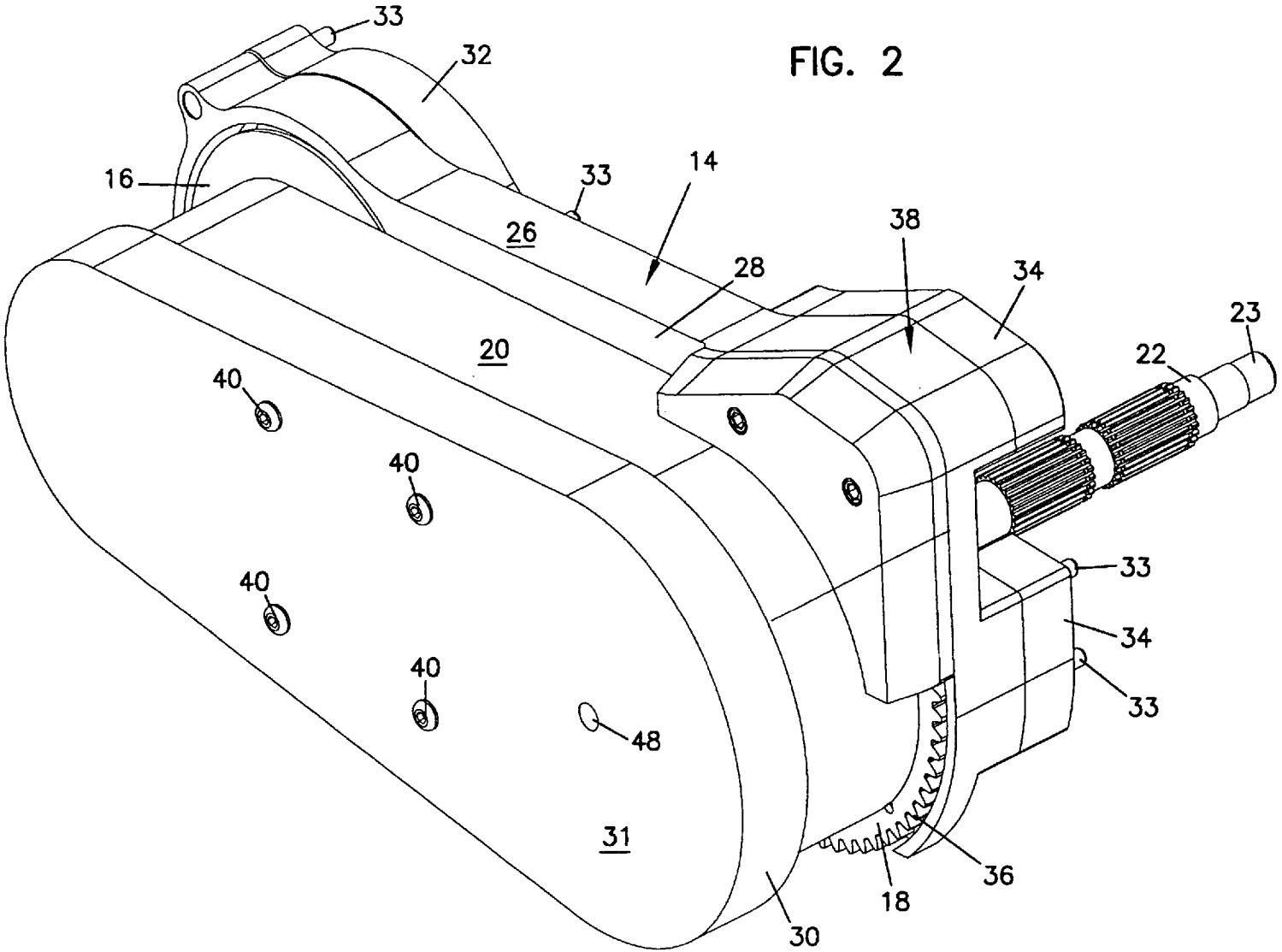
FIG. 2 is a rear perspective view of the primary drive assembly of FIG. 1.
Figure 3:
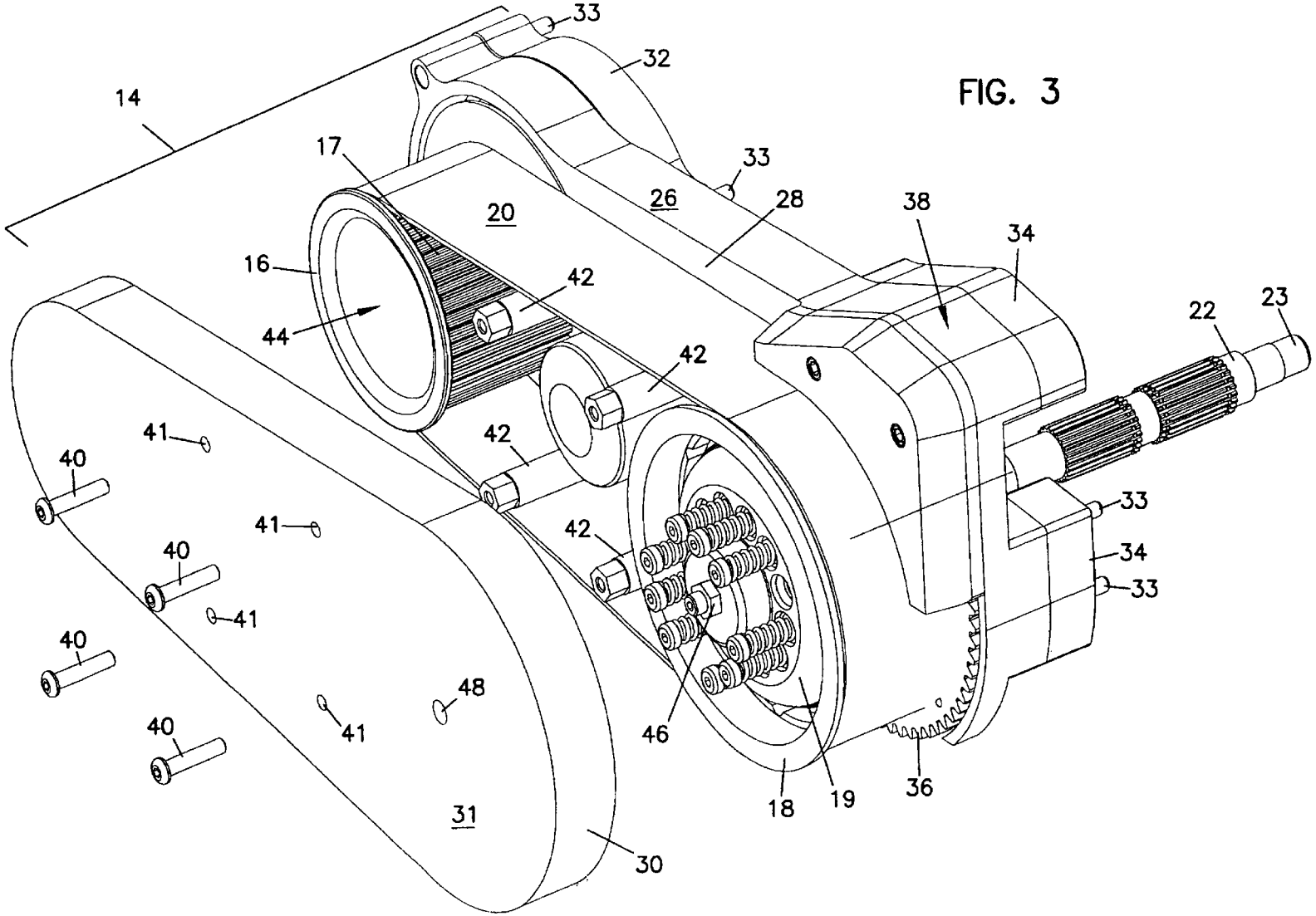
FIG. 3 is a partially exploded view of the primary drive assembly of FIG. 2.
Figure 4:
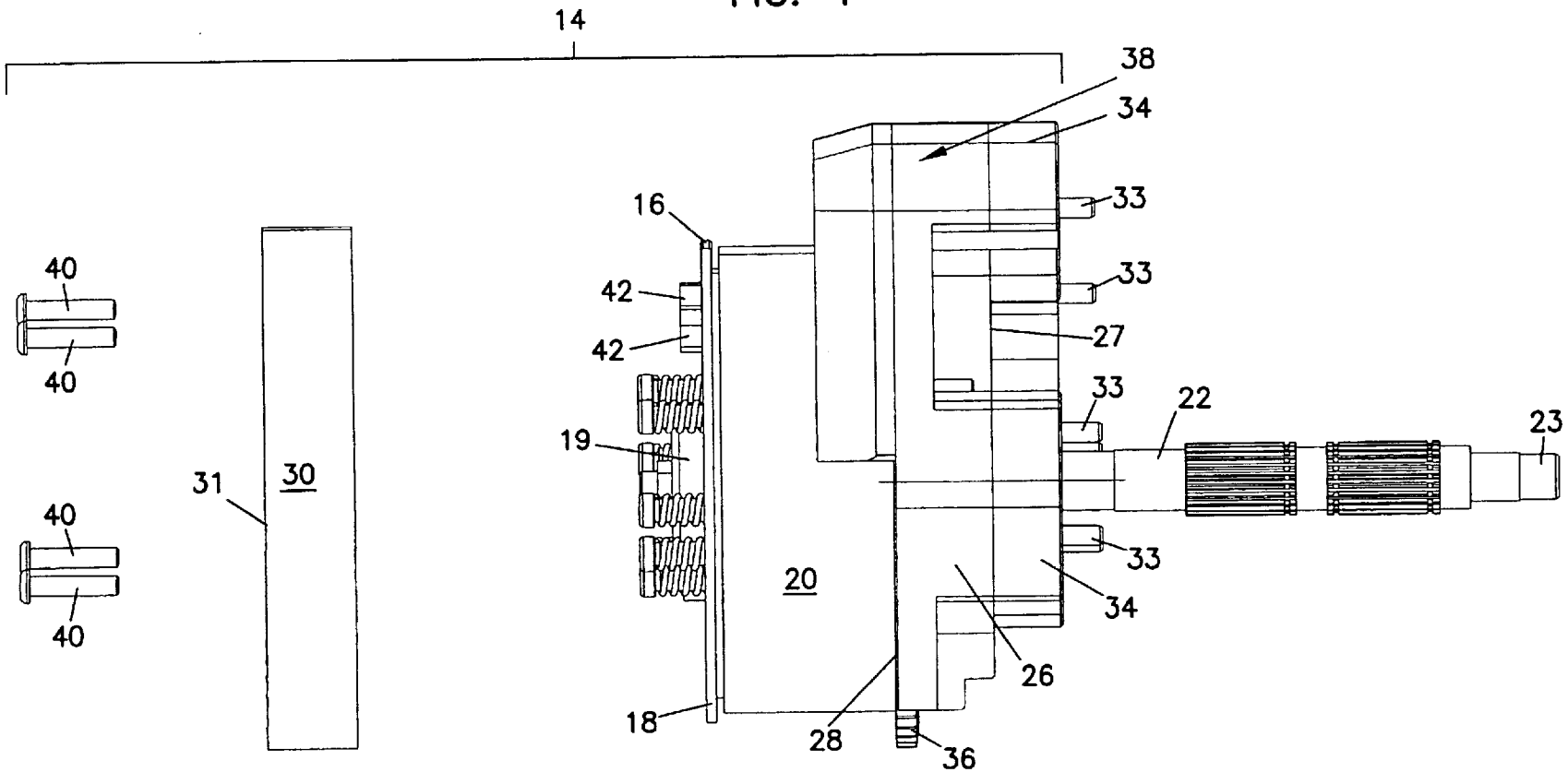
FIG. 4 is a rear view of the partially exploded primary drive assembly of FIG. 3.
Figure 5:
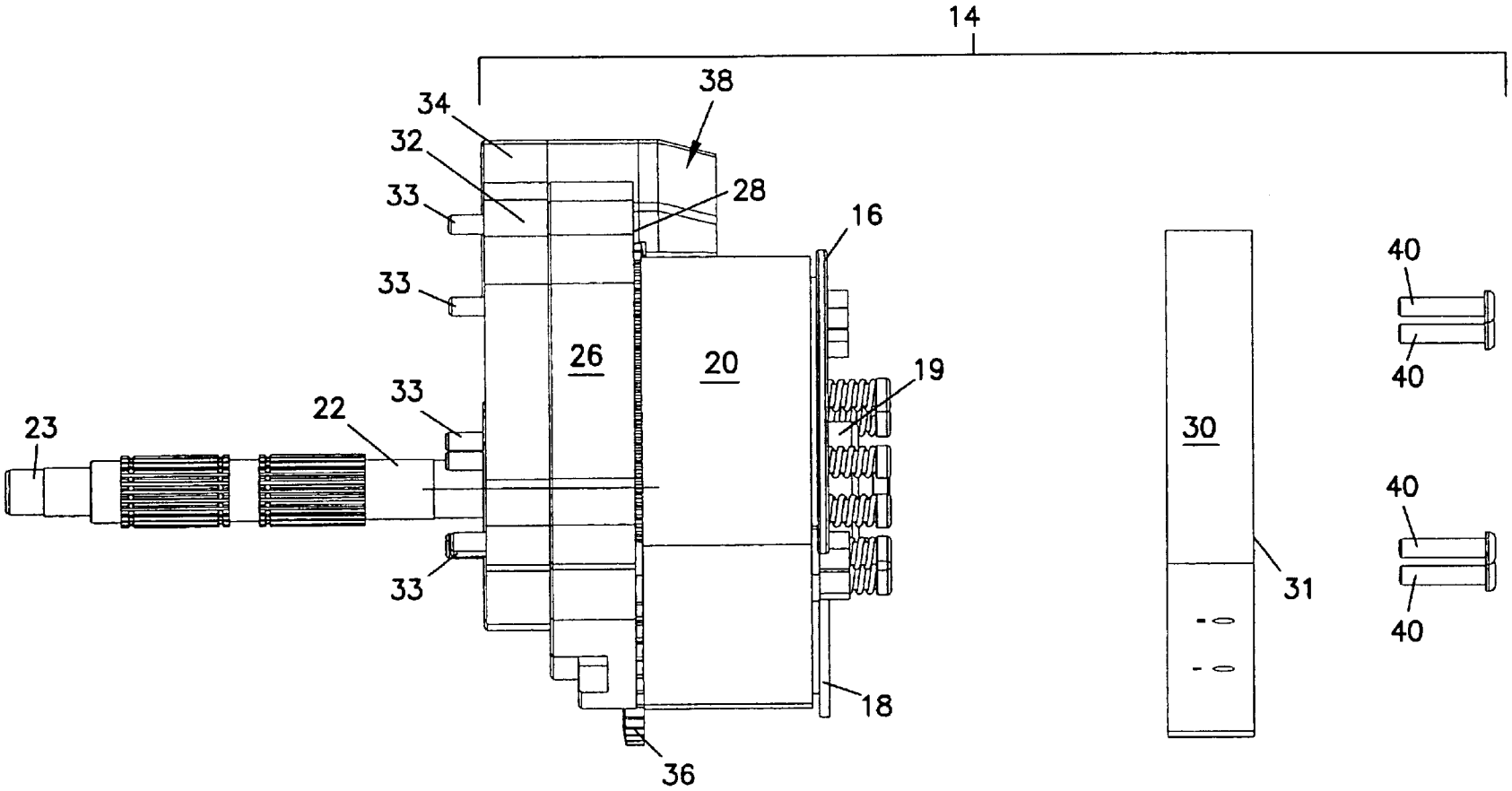
FIG. 5 is a front view of the partially exploded primary drive assembly of FIG. 3.
Figure 6:
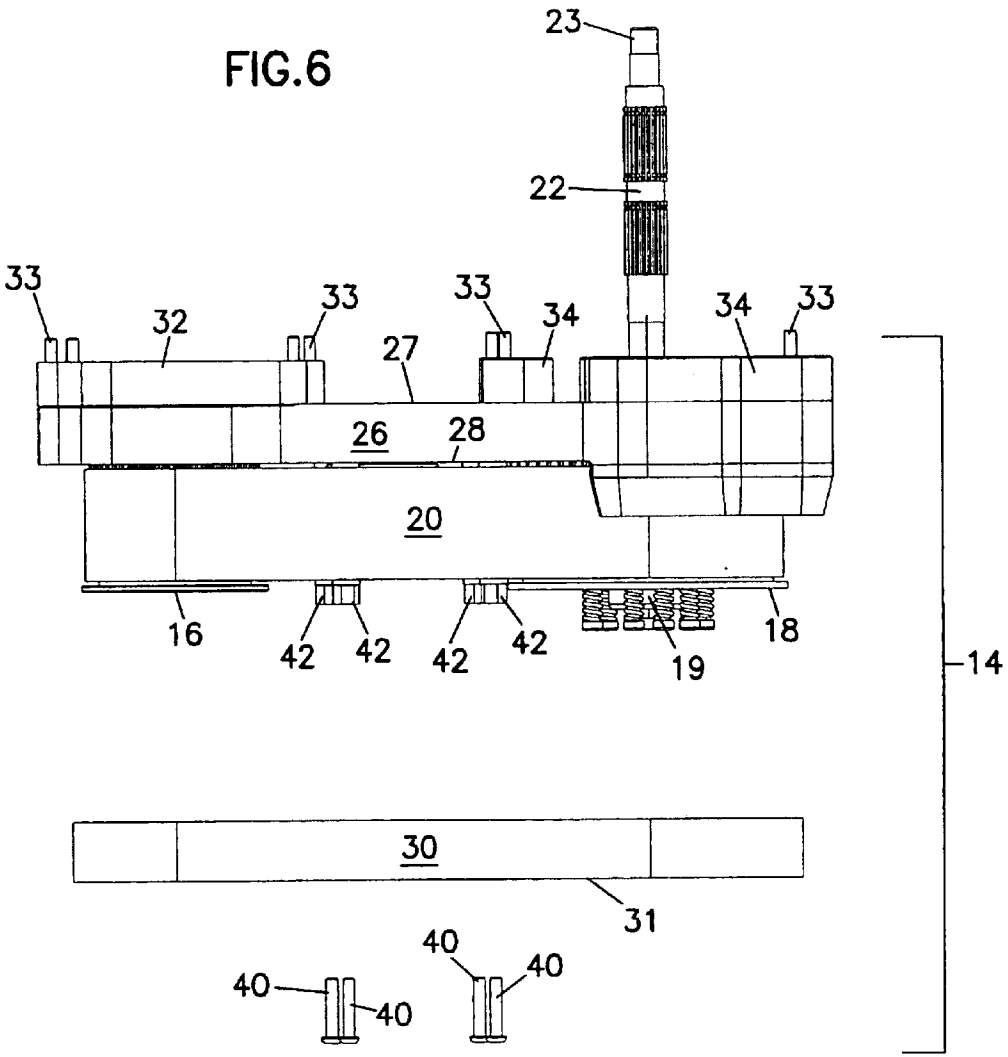
FIG. 6 is a top view of the partially exploded primary drive assembly of FIG. 3.
Figure 7:
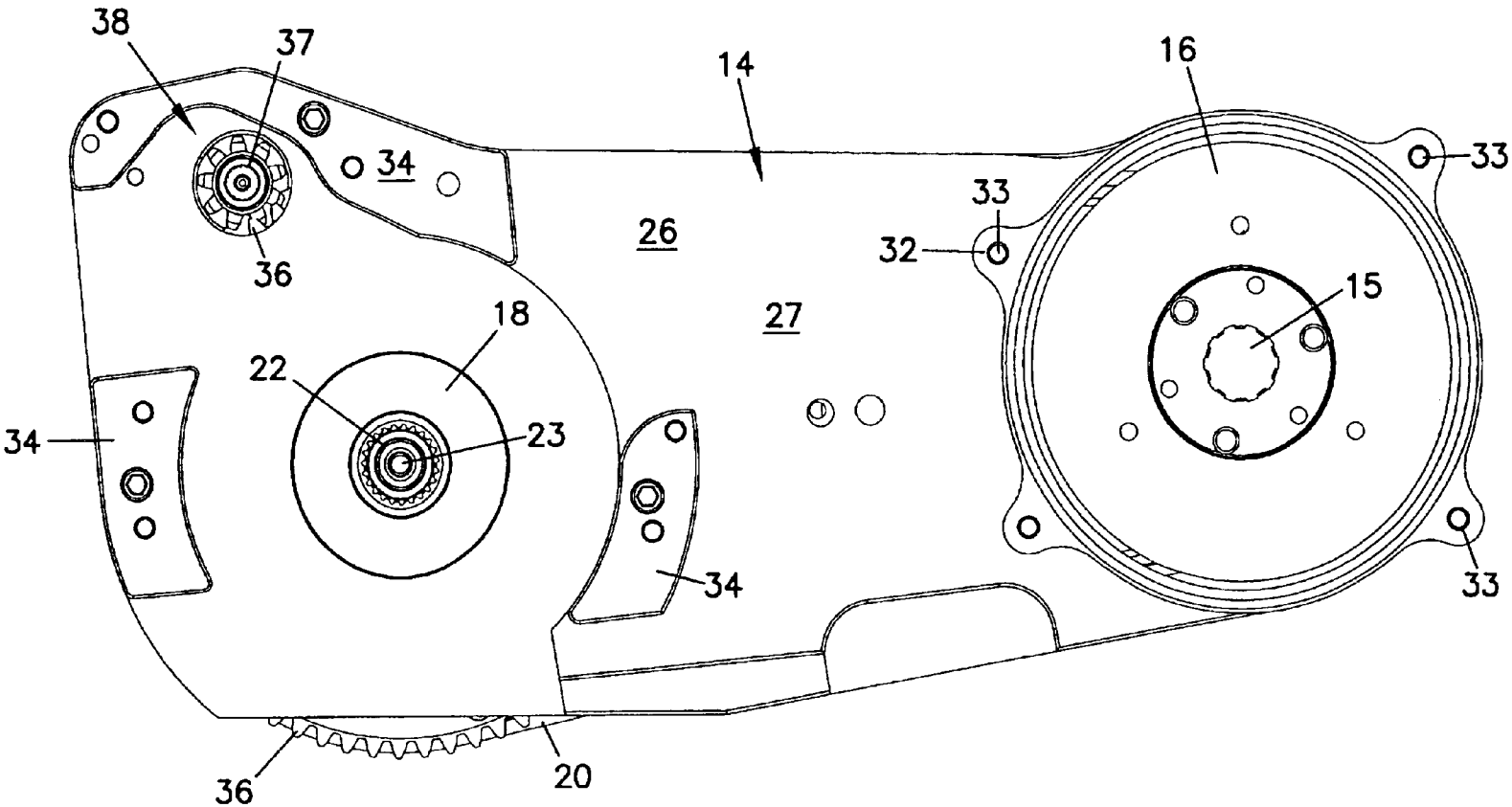
FIG. 7 is a first side view of the primary drive assembly of FIG. 2
Figure 8:
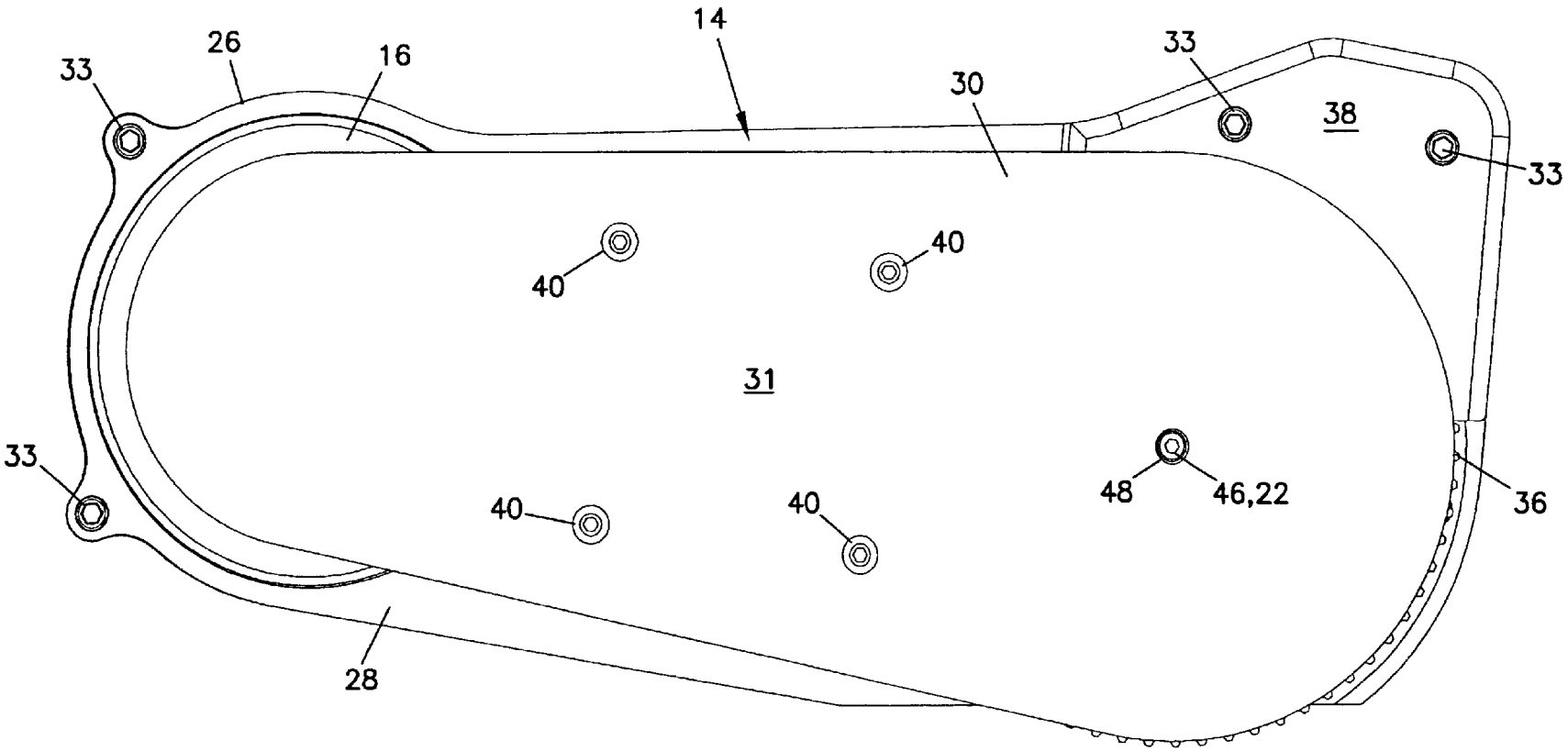
FIG. 8 is a second opposite side view of the primary drive assembly of FIG. 2.
Figure 9:
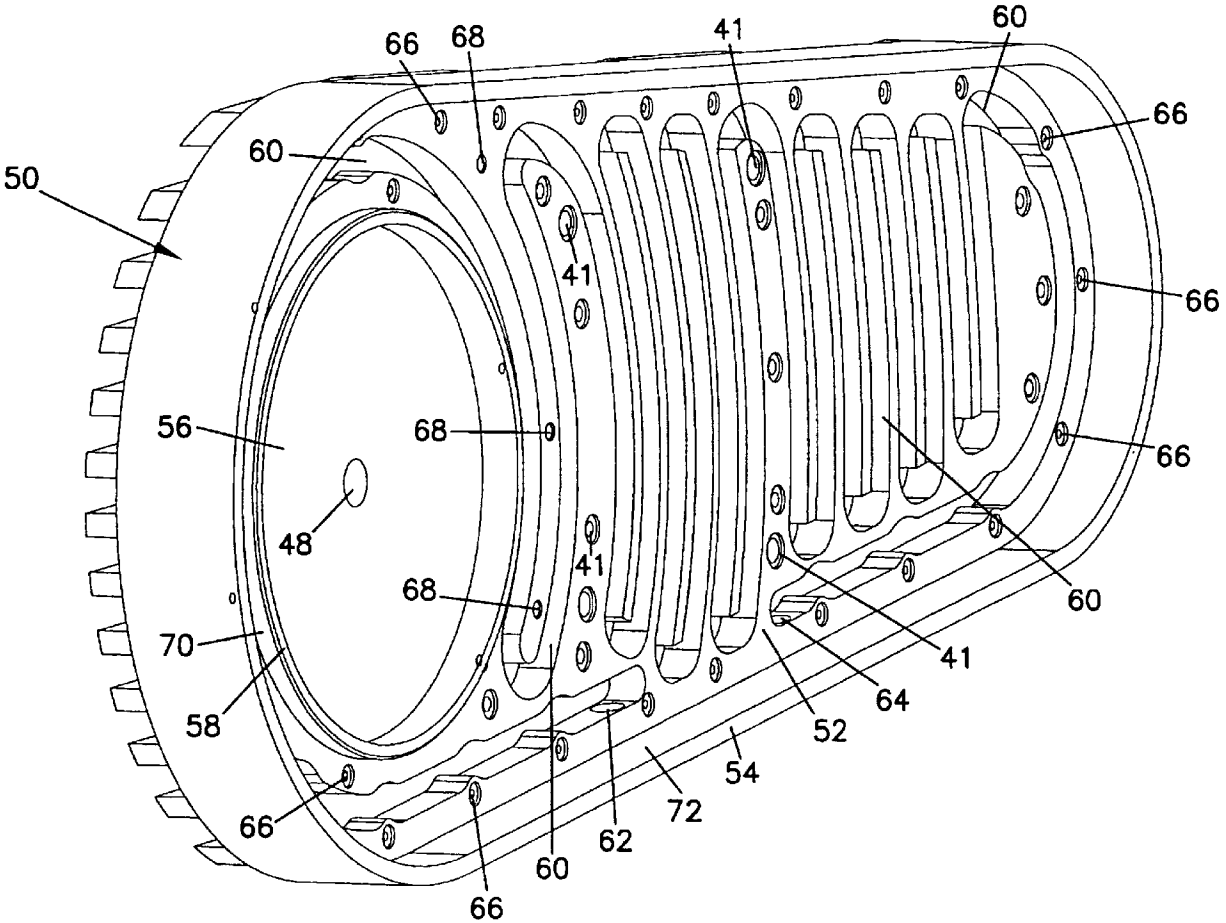
FIG. 9 is a perspective view of an inner face of an outer housing of the oil cooler of FIG. 2.
Figure 10:
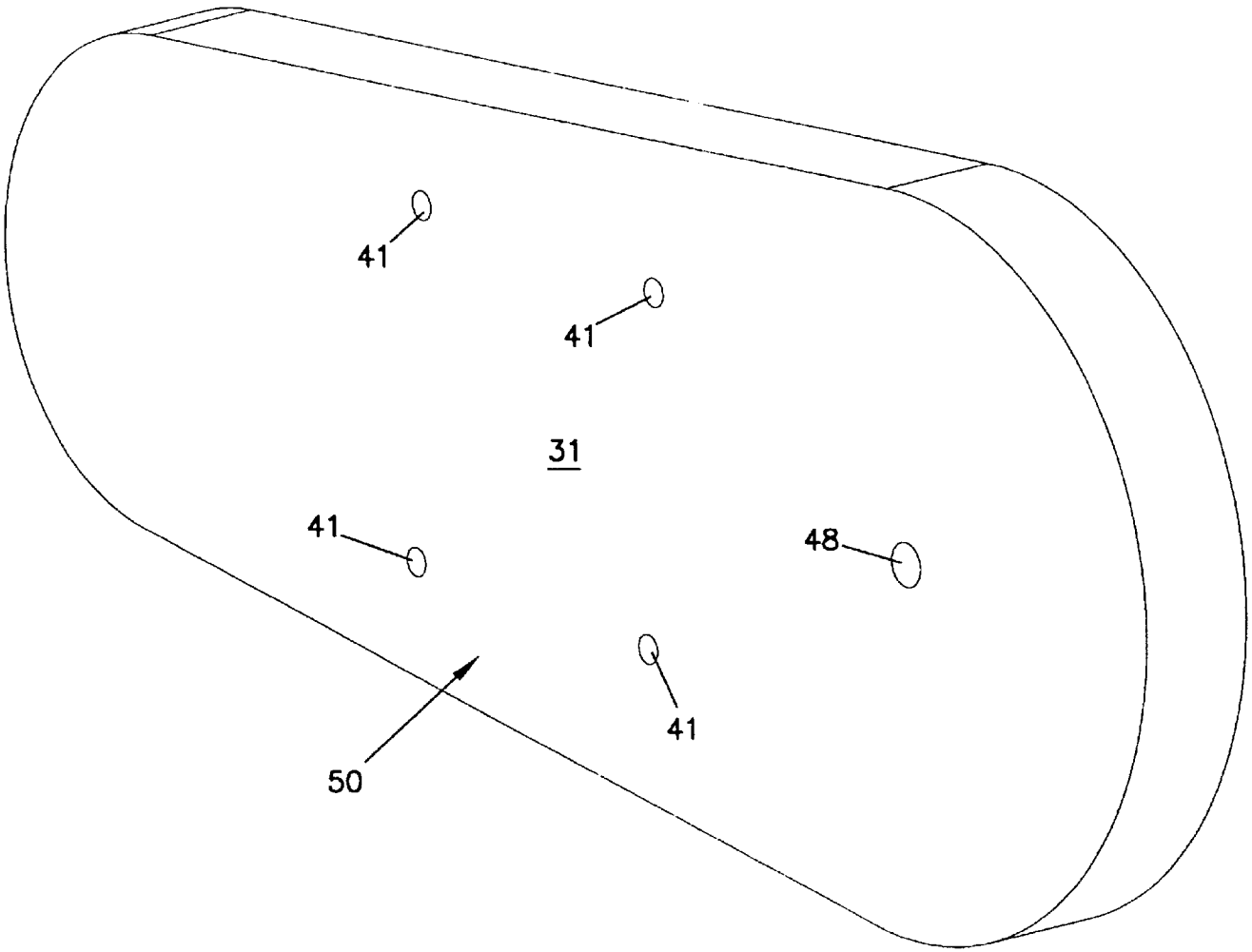
FIG. 10 is a perspective view of an outer face of the outer housing of FIG. 9.

FIG. 1 shows a motorcycle engine 10 with a transmission 12 and a primary drive assembly 14. As shown in FIGS. 2 through 8, primary drive 14 includes a front pulley 16 and a rear pulley 18 and a belt 20 about both the pulleys. An inner surface 24 of a drive housing 26 of primary drive 14 is positioned adjacent a mount 32 of engine 10 and a mount 34 of transmission 12. A plurality of fasteners 33 extend from primary drive assembly 14 through mounts 32 and 34 for fastening primary drive assembly 14 to engine 10 and transmission 12. Front pulley 16 and rear pulley 18 are mounted adjacent an outer surface 28 of drive housing 26. Front pulley 16 is rotated by engine 10 and belt 20 transmits the movement of pulley 16 to pulley 18. Pulley 18 in turn rotates an input shaft 22 (shown in FIGS. 2 and 3) engaged by transmission 12. Pulley 18 includes a clutch assembly 19 which permits the selective engagement or disengagement of the transfer of movement of pulley 16 to through pulley 18 to input shaft 22. Transmission 12 provides a series of gear ratios for transmitting the movement of pulley 18 through a rear drive system attached to an opposite end 23 of shaft 22 to a rear wheel of a motorcycle (not shown). An oil cooler assembly 30 is mounted to primary drive 14 outboard of pulleys 16 and 18, and belt 20.

Rear pulley 18 includes an outer toothed starter ring 36 which is engaged by an electric starter 37 (shown in FIG. 7) mounted within a starter housing 38, defined cooperatively by mount 34 and housing 14. A plurality of bolts 40 positioned through openings 41 of oil cooler assembly 30 engage mounting studs 42 extending from drive housing 26 between pulleys 16 and 18 and inside belt 20. Oil cooler assembly 30 includes an outer face 31 positioned opposite from outer surface 28 of housing 26. Housing 26 also includes an inner surface 27 positioned toward engine 10 and transmission 12, opposite outer surface 28.

Pulley 16 rotates about a central axis 44 and pulley 18 rotates about a central axis 46. Pulley 16 includes a plurality of teeth 17 to engage mating teeth on an inner surface of belt 20 (these mating teeth are not shown in the FIGS. but are well known). Pulley 18 includes a similar arrangement of teeth 17 for engaging belt 20 as well, although these teeth are not visible in the FIGS. Pulley 16 includes a splined opening 15 into which a drive shaft from engine 10 is inserted. Oil cooler assembly 30 also includes an opening 48 positioned in alignment with axis 46 and shaft 22.

As shown, the arrangement of engine 10, transmission 12 and primary drive 14 is characteristic of a classic Harley-Davidson style motorcycle, including after market and third party designs and products with similar arrangements of components. However, oil cooler assembly 30 may also be mounted to other engine, transmission and primary drive arrangements. Engine 10 is anticipated to be a V-Twin engine but oil cooler assembly 30 may also be used with engines including more or fewer cylinders in the same or different configurations. Primary drive 14 as shown is a belt driven drive for transferring power and motion from engine 10 to transmission 12. Oil cooler assembly 30 may also be used with other primary drive arrangements, such as chain drive and shaft drive. As shown, oil cooler assembly 30 is mounted to primary drive 14 by four bolts 40. If desired, oil cooler assembly could also include bearings to support an outboard end of either axis of rotation 44 or 46, or both. Such an arrangement of outboard bearings on oil cooler assembly 30 may be desirable to reduce distortion and flex of primary drive 14 as wider belts 20, and pulleys 16 and 18 are used, or for higher output or displacement engines 10.

FIGS. 9 to 13 show an outer housing 50 of oil cooler assembly 30, including an inner face opposite outer face 31. A wall 54 extends about a perimeter of outer housing 50, completely surrounding inner face 52. Within wall 54 is a space 56 for receiving clutch 19 within pulley 18. As shown in FIGS. 2 to 8, above, clutch 19 extends beyond pulley 18 opposite outer surface 28 of housing 26. Clutch 19 also rotates with pulley 18 about axis 46. A clutch space 56 is centered about opening 48 and is sized to permit clutch 19 to rotate without interference from any portion of oil cooler assembly 30. A second wall 58 surrounds clutch space 56 but does not extend as far beyond inner face 52 as outer wall 54. Second wall 58 extends approximately as far from inner face 52 as the thickness of an inner plate 100, shown in FIGS. 14 and 15, and described in further detail below. Outer wall 54 extends further from inner face 52 than the thickness of inner plate 100 so that when inner plate 100 is mounted to outer housing 50 to form oil cooler assembly 30, outer wall 54 forms a lip about an inner perimeter of oil cooler assembly 30.

On inner face 52 of outer housing 54 are a plurality of oil passages 60, forming a continuous path between an oil input opening 62 and an oil outlet 64. Oil passages 60 do not extend from inner face 52 to outer face 31, but only extend partially through the thickness of outer housing 50. Engine oil from engine 10 is directed into inlet 62 of oil cooler assembly 30, passes through oil passages 60, and exits oil cooler assembly 30 through outlet 64 to be returned for circulation through engine 10. A plurality of mounting screw openings 66 are included on inner face 52 and also do not extend through outer housing 50 to outer face 31. Most of these mounting screw openings include concentric counter bores to permit O-rings or other seals to be placed about a screw used to mount inner plate 100 to inner face 52 and reduce seepage or leakage of oil from oil cooler assembly 30. Some screw openings 68 are included in inner face 52 do not include counter bores or other provisions for concentric O-rings due to space or material considerations. Mounting openings 41 for receiving fasteners 40 to mount oil cooler assembly to primary drive 14 also do not include counter bores for gaskets or O-rings. It is expected that seepage from screws in these openings 68 will be minimal or that other provisions for stopping leakage will be provided. If seepage is excessive, openings 68 where there is insufficient surrounding space on inner face 52 to provide a counter bore may be removed from outer housing 50. Other openings such as openings 41 may be provided with counter bores to allow mounted an o-ring or other seal.

Outer wall 54 includes a smooth, continuous inner face 72 to provide a sealing surface about the perimeter of inner face 52. Inner plate 100 includes a groove 102 about an outer edge 104 (shown in FIGS. 14 and 15), for receiving a gasket which is then compressed between inner face 72 to provide a leak and seepage proof seal about the perimeter of inner face 52. A smooth continuous outer face 70 of wall 58 similarly provides a sealing surface about space 56. While outer face 70 is shown without a gasket groove, such a groove might be included.

Figure 11:
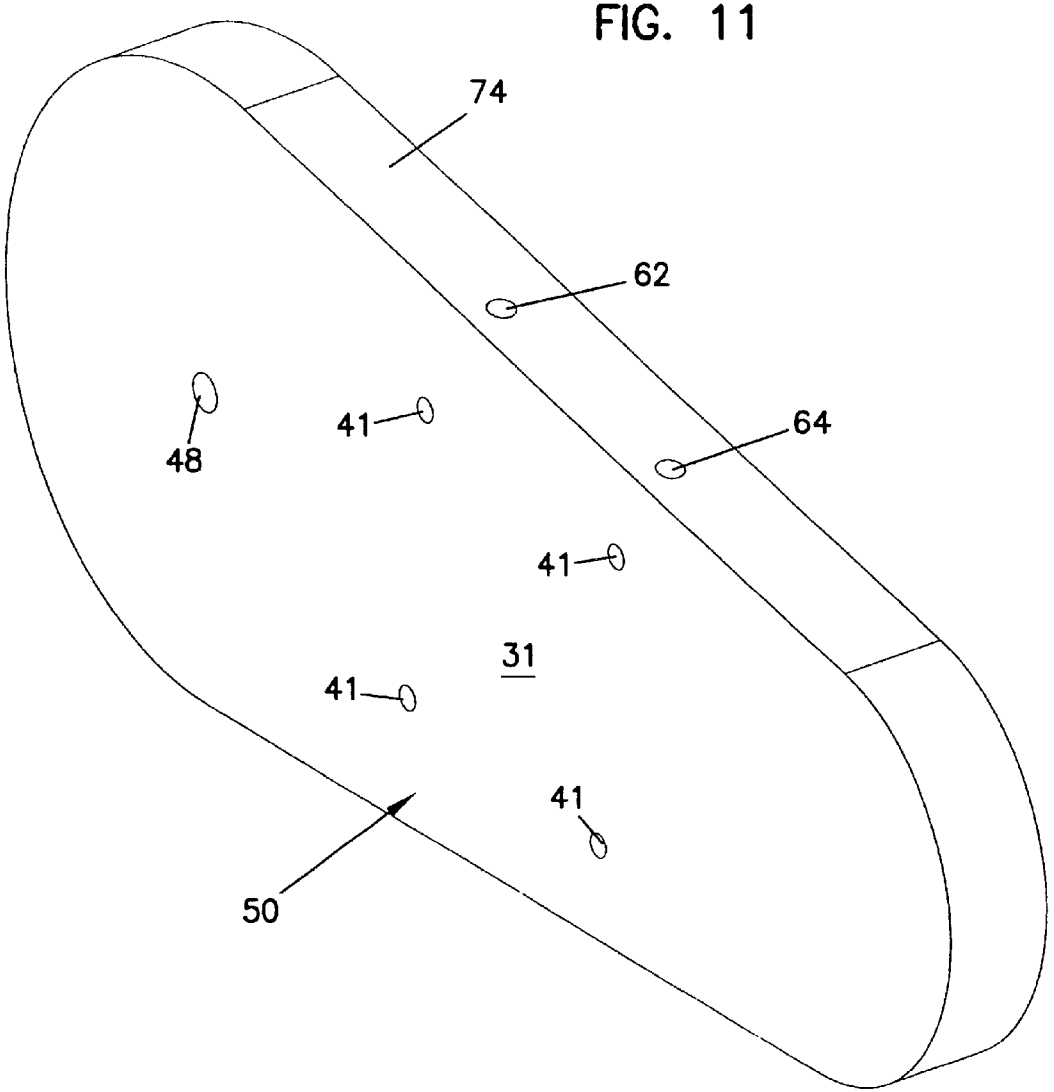
FIG. 11 is a perspective view of a lower edge of the outer housing of FIG. 9.
Figure 12:
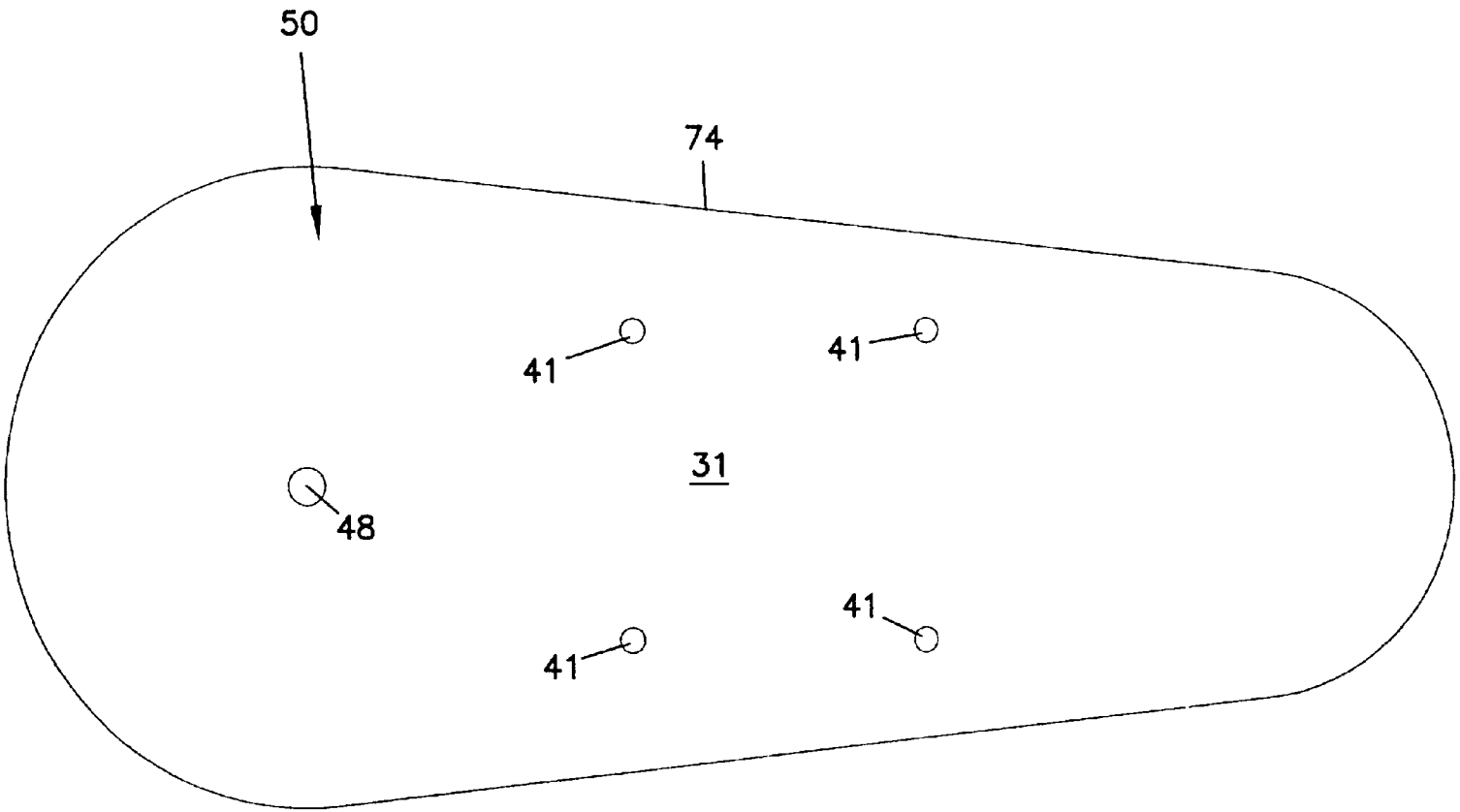
FIG. 12 is a side view of the outer face of the outer housing of FIG. 9.
Figure 13:
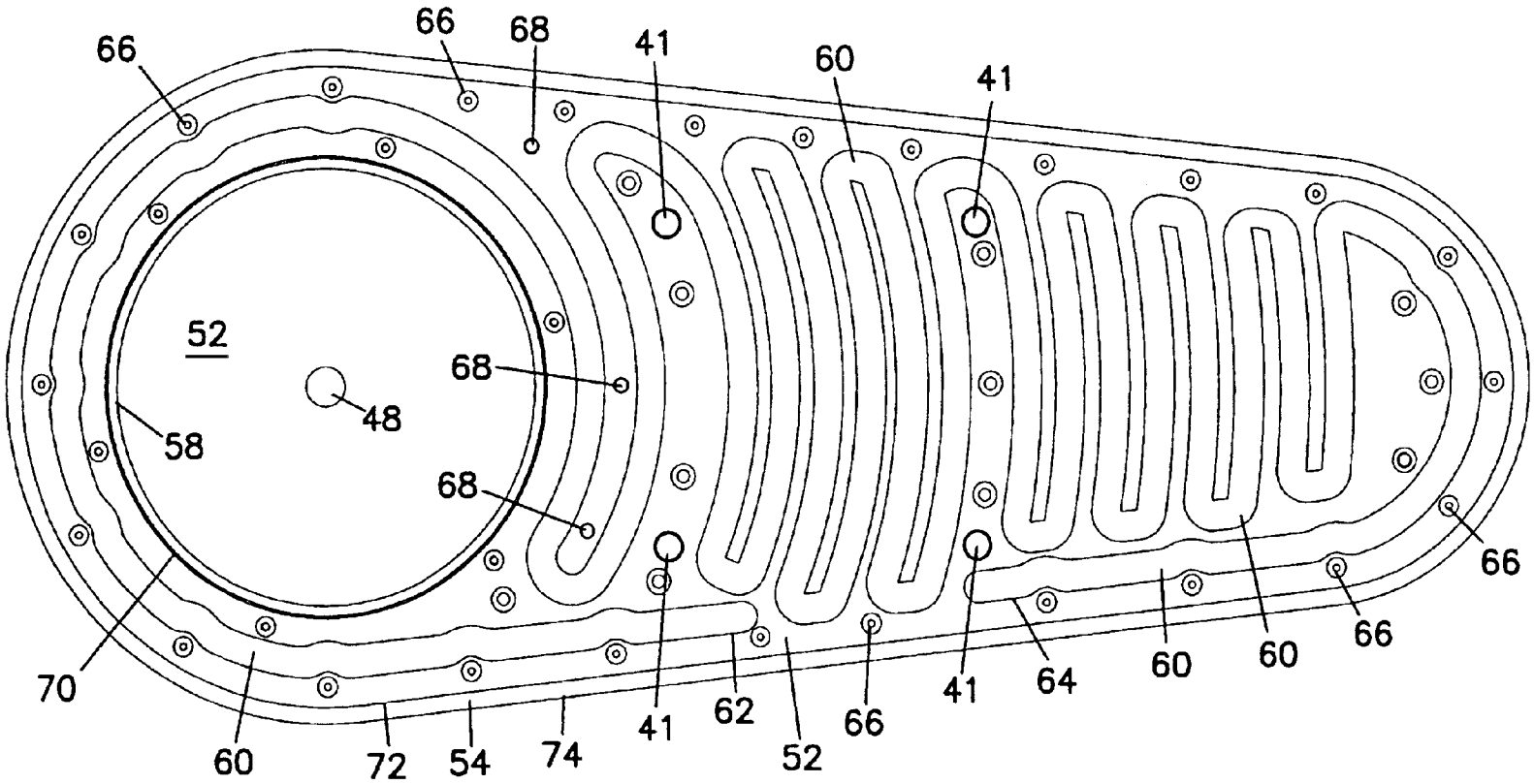
FIG. 13 is a side view of the inner face of the outer housing of FIG. 9.

As shown in FIGS. 11 and 12, outer housing 50 includes a lower edge 74 through which inlet 62 and outlet 64 extend. Inlet 62 and outlet 64 are positioned on lower edge 74 to reduce visibility of these features and to permit routing of oil supply lines to and from oil cooler assembly from beneath belt 20.

Figure 14:
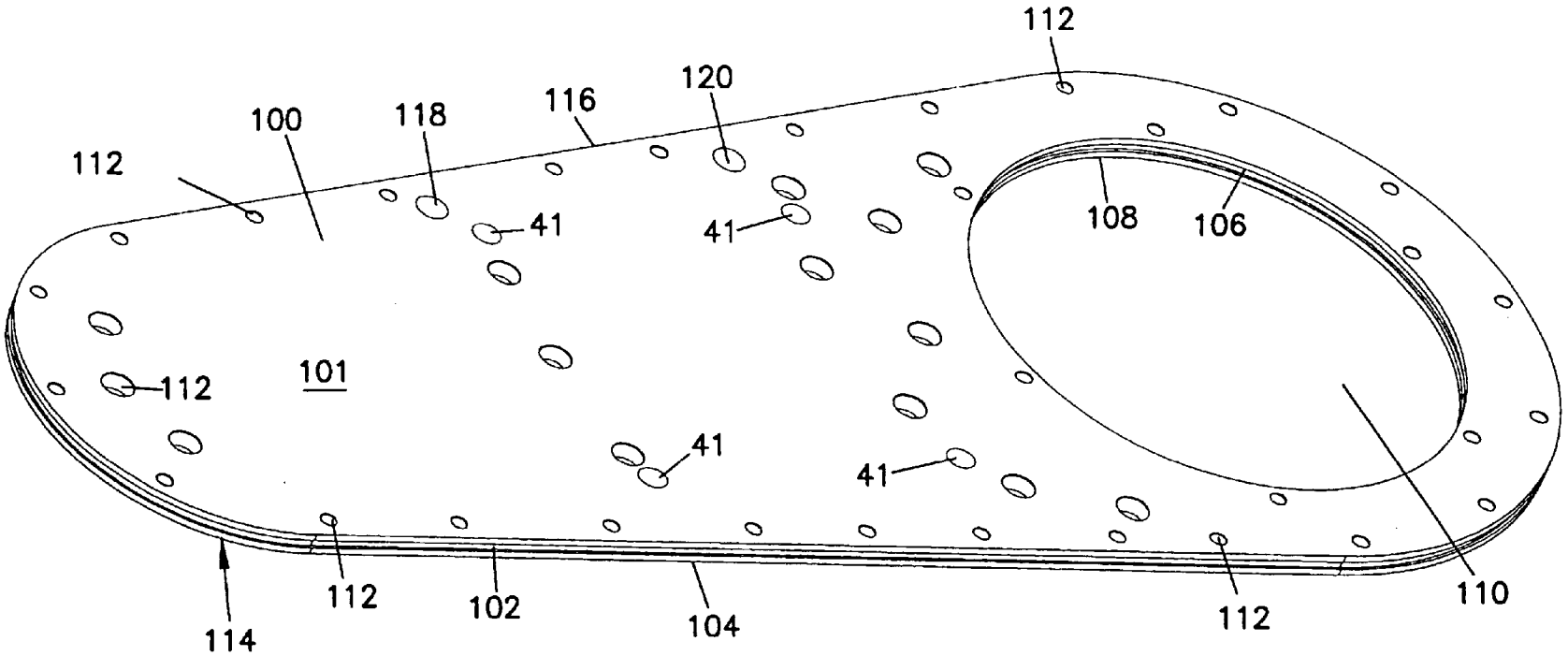
FIG. 14 is a perspective view of an inner plate of the oil cooler of FIG. 2.
Figure 15:
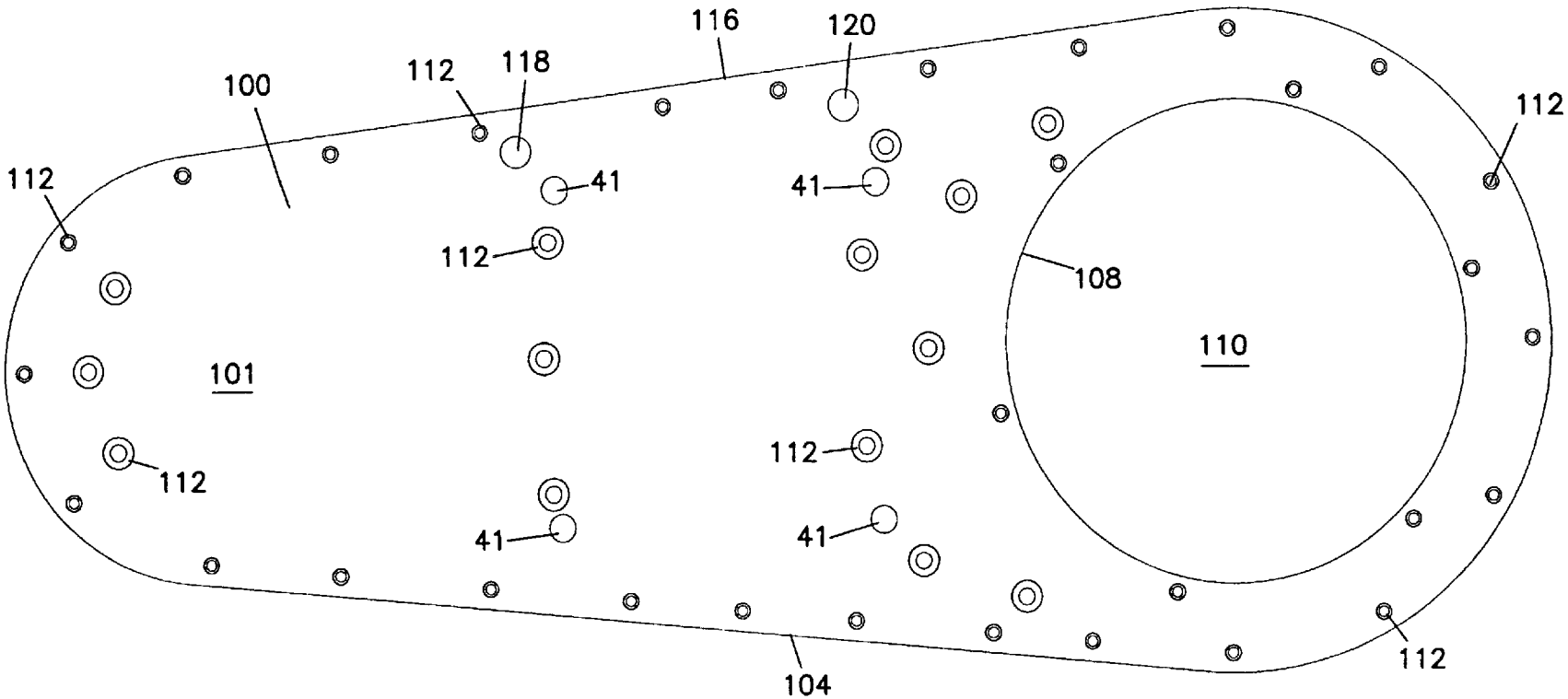
FIG. 15 is a side view of the inner plate of FIG. 14.

Referring now to FIGS. 14 and 15, inner plate 100 of oil cooler assembly 30 includes an inner face 101 and an outer face 114. When mounted to outer housing 50, outer face 114 is positioned adjacent inner face 52, and a lower edge 116 of inner plate 100 is positioned along inner face 72 of outer wall 54 adjacent lower edge 74. As noted above, groove 102 extends about an outer edge 104 of plate 100. A groove 106 extends along an inner edge 108 defining an opening 10 sized to fit about outer face 70 of wall 58. A plurality of fastener openings 112 included in inner plate 100 to receiving fasteners to mount inner plate 100 to outer housing 50. As shown, fastener openings 112 are include counter bores on inner face 101 to permit fastener heads, such as screw heads, to be recessed within inner plate 100 and not extend beyond plate 100 toward primary drive 14.

Also included on inner plate 100 are a pair of alternative oil ports, an inlet 118 and an outlet 120. If it is desirable to direct oil supply lines to and from engine 10 within belt 20, oil ports 118 and 120 permit oil to enter passages 60 through inner plate 100. While two oil inlets (62 and 118) and two oil outlets (64 and 120) are shown, it is preferable that only one of each be used when plumbing the oil lines from engine 10 to oil cooler assembly 30.

Figure 16:
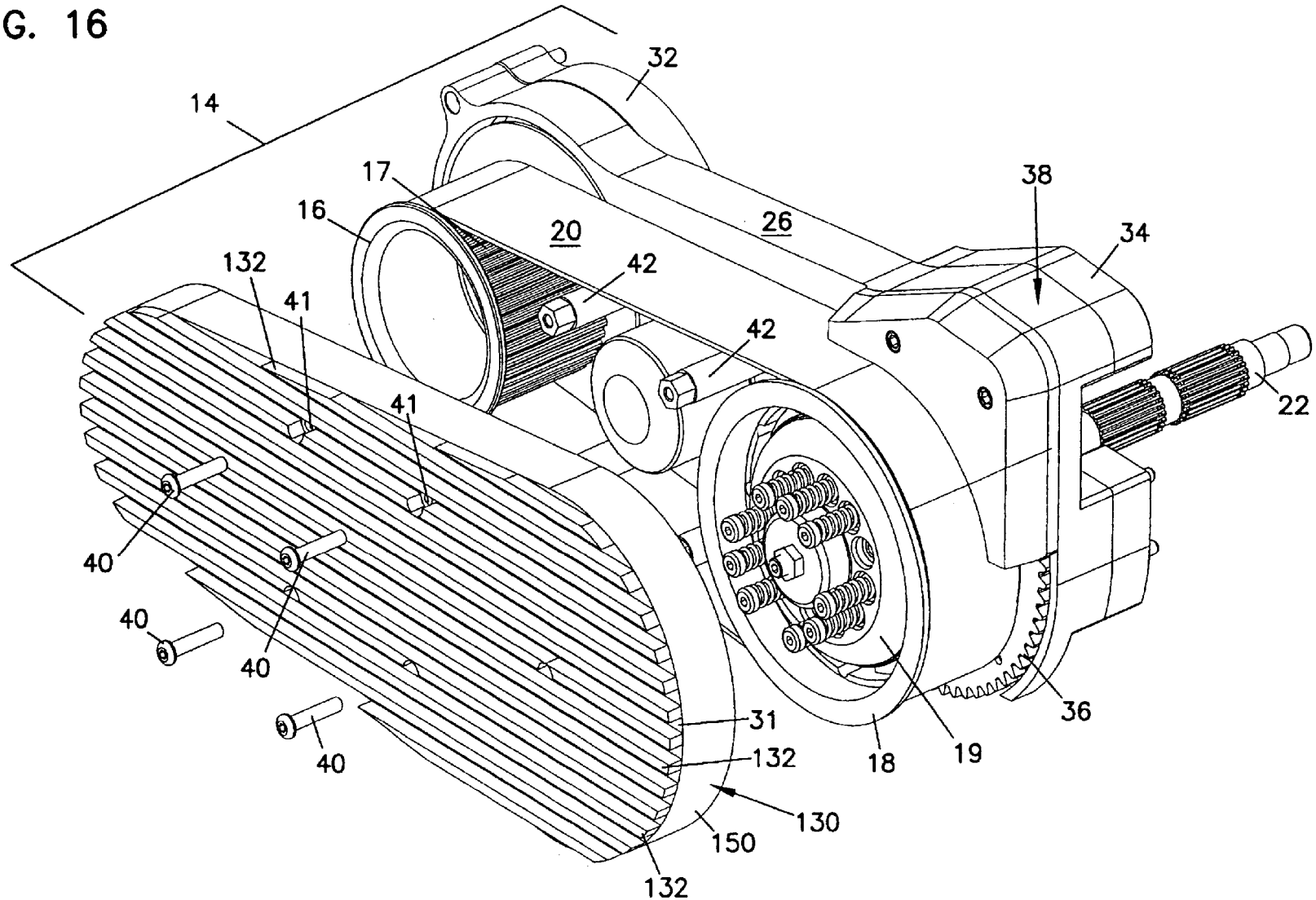
FIG. 16 is a rear perspective view of a primary drive assembly for a motorcycle including a first alternative embodiment of an oil cooler according to the present invention.
Figure 17:
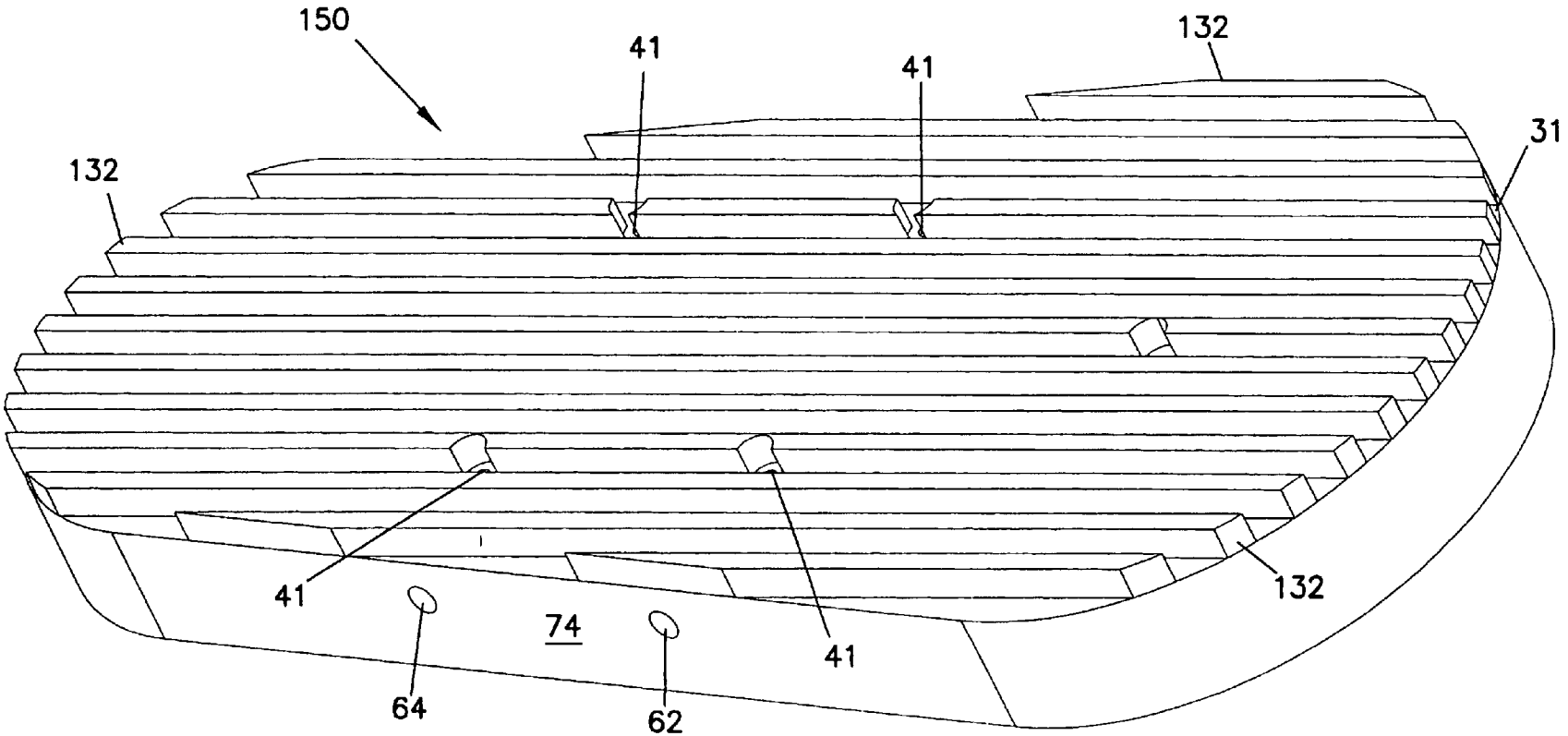
FIG. 17 is a lower perspective view of an outer housing of the oil cooler of FIG. 16.
Figure 18:
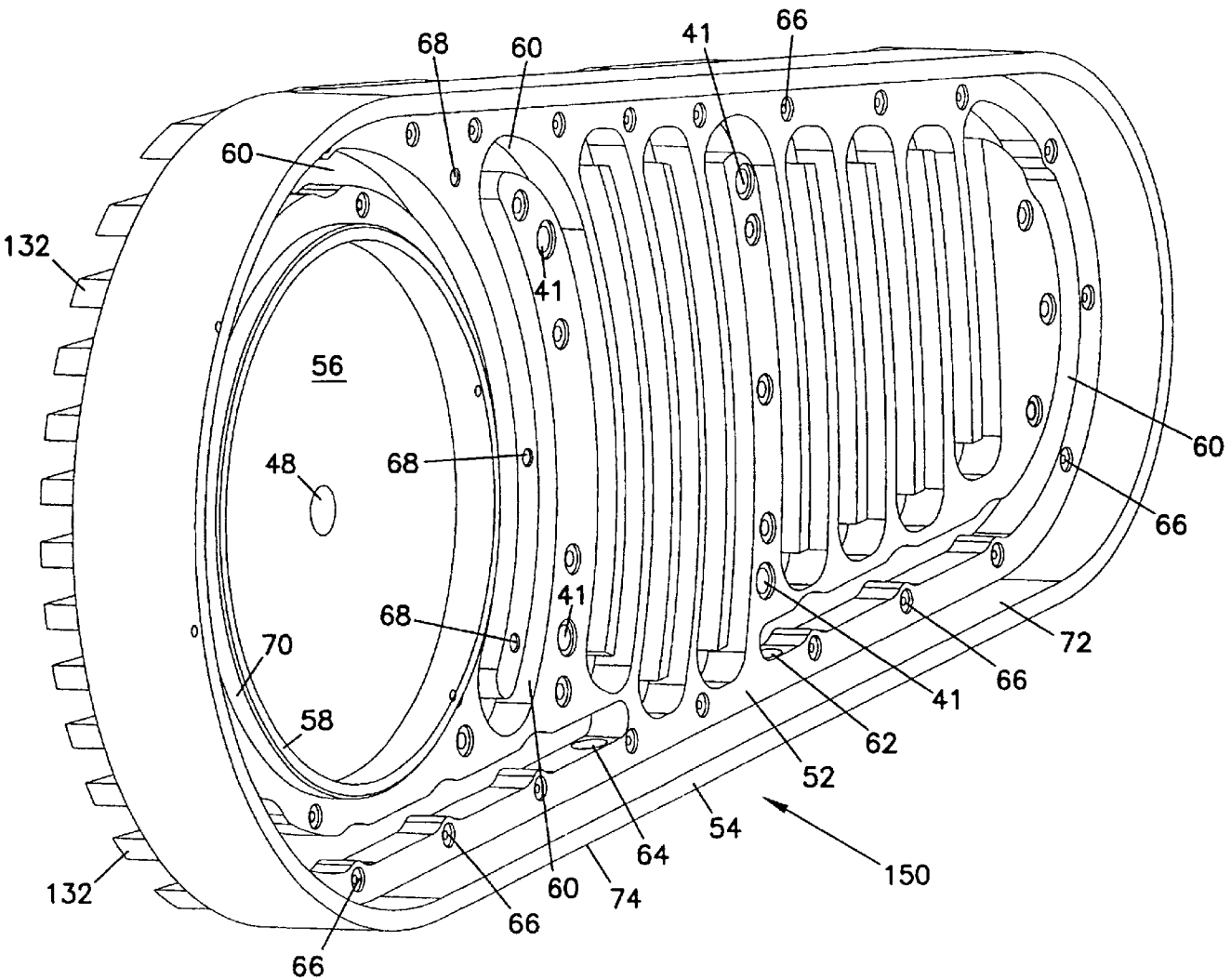
FIG. 18 is a perspective view of an inner face of the outer housing of FIG. 17.

Referring now to FIG. 16, a first alternative embodiment oil cooler assembly 130 is shown, with an outer housing 150 including a plurality of fins 132 extending from outer face 31. Fins 132 provide increased surface area to aid in heat dissipation by oil cooler assembly 130. FIGS. 17 to 21 show outer housing 150 of oil cooler assembly 130. Outer housing 150 is similar to outer housing 50 in other respects but differs in that outer surface 31 includes fins 132. Outer housing 150 is also sized and configured to receive inner plate 100 similar to outer housing 50.

It is well known to use fins 132 or other similar structures on fluid cooling housing to add surface area and improve the heat transfer from the housing to a cooling medium (for example, air). Other similar types of external structures may be included on outer face 31 of outer housing 150 or 50 to provide increased surface area to housing 150 or 50. Alternative structures include ridges, raised decorative features, or other surface treatments or features.

The embodiments of the inventions disclosed herein have been discussed for the purpose of familiarizing the reader with novel aspects of the present invention. Although preferred embodiments have been shown and described, many changes, modifications, and substitutions may be made by one having skill in the art without unnecessarily departing from the spirit and scope of the present invention. Having described preferred aspects and embodiments of the present invention, modifications and equivalents of the disclosed concepts may readily occur to one skilled in the art. However, it is intended that such modifications and equivalents be included within the scope of the claims which are appended hereto.

What is claimed is:

1. A fluid cooling arrangement for a motorcycle comprising:

a fluid cooler including an outer housing and an inner plate, the outer housing including an outer face and an inner face, the inner plate mounted to the inner face of the outer housing, and a continuous fluid passage defined between the inner face and the inner plate, the fluid passage extending between a fluid inlet and a fluid outlet;

an engine with an output shaft;

a transmission with an input shaft;

a primary drive connecting the output shaft to the input shaft, the primary drive including a member for transmitting movement of the output shaft to the input shaft; and the fluid cooler mounted to the primary drive with the fluid inlet in fluid communication with a source of heated fluid from the engine.

2. The fluid cooling arrangement of claim 1, wherein the outer face of the outer housing includes a plurality of fins.

3. The fluid cooling arrangement of claim 1, wherein the outer face of the outer housing is smooth.

4. The fluid cooling arrangement of claim 1, wherein the heated fluid is lubricating oil circulated through the engine.

5. The fluid cooling arrangement of claim 1, wherein the fluid inlet is located on a lower surface of the outer housing.

6. The fluid cooling arrangement of claim 1, wherein the fluid outlet is located on a lower surface of the outer housing.

7. The fluid cooling arrangement of claim 1, wherein the fluid inlet is located on an inner face of the inner plate.

8. The fluid cooling arrangement of claim 1, wherein the fluid outlet is located on an inner face of the inner plate.

9. An oil cooler for a motorcycle comprising:

an assembly including an outer housing having an inner face and an outer face, and an inner plate mounted to the inner face of the outer housing;

a plurality of fluid passages between the inner plate and the inner face defining a continuous oil path from an oil inlet to an oil outlet;

the outer housing and inner plate assembly adapted for mounting to an outer portion of a primary drive of a motorcycle.

10. The oil cooler of claim 9, wherein the outer face of the outer housing includes a plurality of fins.

11. The oil cooler of claim 10, wherein the outer face of the outer housing is smooth.

12. The oil cooler of claim 9, wherein the oil inlet is located on a lower surface of the outer plate.

13. The oil cooler of claim 9, wherein the oil outlet is located on a lower surface of the outer plate.

14. The oil cooler of claim 9, wherein the oil inlet is located on an inner face of the inner plate.

15. The oil cooler of claim 9, wherein the oil outlet is located on an inner face of the inner plate.

16. A method of mounting an oil cooler to a motorcycle comprising:

providing a motorcycle with an engine including an output shaft, a transmission with an input shaft, and a primary drive connecting the output shaft to the input shaft, the primary drive including a member for transmitting movement of the output shaft to the input shaft;

mounting an inner plate to an inner face of an outer housing to form an oil cooler assembly, the oil cooler assembly including a plurality of oil passages between the inner plate and the inner face for routing oil from an oil inlet to an oil outlet;

attaching the oil cooler assembly to an outer portion of the primary drive with the oil cooler assembly positioned as a member guard;

connecting the oil inlet of the cooler assembly with a source of heated oil from the engine.

* * * * *

UNITED STATES PATENT AND TRADEMARK OFFICE

CERTIFICATE OF CORRECTION

PATENT NO. : 6,871,628 B1
DATED : March 29, 2005
INVENTOR(S) : Tauer

It is certified that error appears in the above-identified patent and that said Letters Patent is hereby corrected as shown below:

Column 1,
Line 14, “beat” should read -- “heat” --.

Column 6,
Line 40, the reference to claim “10” should be -- “9” --.
Lines 44 and 46, “outer plate” should read -- outer housing --.

Signed and Sealed this

Twentieth Day of September, 2005

JON W. DUDAS
*Director of the United States Patent and Trademark Office*